US008960438B2

(12) United States Patent
Murray

(10) Patent No.: US 8,960,438 B2
(45) Date of Patent: Feb. 24, 2015

(54) MULTI-COMPARTMENT FLEXIBLE POUCH WITH AN INSULATED COMPARTMENT

(75) Inventor: R. Charles Murray, Lakewood Ranch, FL (US)

(73) Assignee: Pouch Pac Innovations, LLC, Sarasota, FL (US)

( * ) Notice: Subject to any disclaimer, the term of this patent is extended or adjusted under 35 U.S.C. 154(b) by 1636 days.

(21) Appl. No.: 12/178,686

(22) Filed: Jul. 24, 2008

(65) Prior Publication Data

US 2008/0276645 A1 Nov. 13, 2008

Related U.S. Application Data

(63) Continuation-in-part of application No. 11/367,613, filed on Mar. 3, 2006, now abandoned.

(60) Provisional application No. 60/658,126, filed on Mar. 3, 2005.

(51) Int. Cl.

| | |
|---|---|
| ***B65D 85/84*** | (2006.01) |
| ***B65D 81/32*** | (2006.01) |
| ***B65D 77/22*** | (2006.01) |
| ***B65B 43/46*** | (2006.01) |
| ***B65B 43/60*** | (2006.01) |
| *B65D 75/58* | (2006.01) |
| *B65D 75/54* | (2006.01) |
| *B65D 75/48* | (2006.01) |

(52) U.S. Cl.

CPC ..... *B65B 43/465* (2013.01); *B65D 75/5816* (2013.01); *B65D 81/3266* (2013.01); *B65D 77/225* (2013.01); *B65D 75/54* (2013.01); *B65B 43/60* (2013.01); *B65D 2231/02* (2013.01); *B65D 75/5861* (2013.01); *B65D 75/48* (2013.01)

USPC ..... 206/524.1; 383/6; 383/110

(58) Field of Classification Search

USPC ..... 206/484, 524.1, 524.6, 525; 383/6, 7, 383/110, 120

See application file for complete search history.

(56) References Cited

U.S. PATENT DOCUMENTS

| | | | | |
|---|---|---|---|---|
| 3,169,379 | A * | 2/1965 | Black | 62/47.1 |
| 4,044,867 | A * | 8/1977 | Fisher | 190/107 |
| 5,118,203 | A * | 6/1992 | Andronico | 383/210.1 |
| 5,135,132 | A * | 8/1992 | Potochnik | 220/592.16 |
| 5,314,086 | A * | 5/1994 | Short | 220/592.16 |
| 5,845,806 | A * | 12/1998 | Parchman | 220/739 |
| 5,957,583 | A * | 9/1999 | DeClements et al. | 383/3 |
| 6,123,217 | A * | 9/2000 | Miller | 220/592.19 |
| 6,139,188 | A * | 10/2000 | Marzano | 383/110 |
| 6,176,613 | B1 * | 1/2001 | Chen | 383/3 |
| 6,283,296 | B1 * | 9/2001 | Newman | 206/522 |
| 7,195,132 | B1 * | 3/2007 | Balam | 220/560 |
| 7,972,063 | B1 * | 7/2011 | Barsalou | 383/3 |
| 2002/0081041 | A1 * | 6/2002 | Malone et al. | 383/3 |
| 2003/0128898 | A1 * | 7/2003 | Malone et al. | 383/3 |
| 2007/0088314 | A1 * | 4/2007 | Gollier et al. | 604/410 |
| 2007/0261974 | A1 * | 11/2007 | Balteau et al. | 206/219 |

* cited by examiner

*Primary Examiner* — Jacob K Ackun

(74) *Attorney, Agent, or Firm* — Gifford, Krass, Sprinkle, Anderson & Citkowski, P.C.

(57) ABSTRACT

A multi-compartment flexible pouch with an insulated compartment and method of forming includes a pouch body formed from a panel of material, and the pouch body has at least one compartment for a product. An opening means for accessing the product is disposed in the pouch body. A first insulating compartment seal having a predetermined shape is applied to the pouch body and a second insulating compartment seal having a predetermined shape is applied to the pouch body and spaced a predetermined distance apart from the first seal to form the insulated compartment. The insulated compartment contains a pressurized gas and a surface temperature of the insulated compartment is less than a surface temperature of the product compartment after the pouch is heated.

3 Claims, 12 Drawing Sheets

MULTI-COMPARTMENT FLEXIBLE POUCH WITH AN INSULATED COMPARTMENT

RELATED APPLICATION

This application is a continuation-in-part of U.S. patent application Ser. No. 11/367,613 filed Mar. 3, 2006, which claims priority of U.S. Provisional Patent Application Ser. No. 60/658,126 filed Mar. 3, 2005, both of which are incorporated herein by reference.

BACKGROUND OF THE INVENTION

1. Field of the Invention

The present invention relates generally to a flexible pouch for packaging products, and more particularly to a flexible pouch having an insulated compartment for packaging a product and a method of manufacturing the same.

2. Description of the Related Art

Various types of disposable, portable containers are known in the art for storing a fluid or dry product, such as a liquid, granular material, powder or the like. An example of such a container is a flexible pouch. Consumers prefer the convenience of flexible pouches over other types of containers, due to their shape, size, shelf life and storage adaptability. Manufacturers recognize the packaging benefits of a flexible pouch, since the pouch can be formed and filled on the same manufacturing line. An example of a method and apparatus for filling a flexible pouch with a product is disclosed in commonly assigned U.S. Pat. No. 6,199,601, which is incorporated herein by reference.

The flexible pouch may also be used for both storing and heating the product contained therein. However, the surface of the flexible pouch may be hot to the touch after heating. Thus, there is a need in the art for a flexible pouch that includes an insulated compartment that can serve as a handle and a method of making such a pouch.

SUMMARY OF THE INVENTION

Accordingly, a multi-compartment flexible pouch is provided for both storing and heating or cooling a product contained therein, and a method of manufacturing such a flexible pouch is provided. The multi-compartment flexible pouch includes a pouch body formed from a panel of material, and the pouch body has at least one compartment for a product. An opening means for accessing the product is disposed in the pouch body. A first insulating compartment seal having a predetermined shape is applied to the pouch body and a second insulating compartment seal having a predetermined shape is applied to the pouch body and spaced a predetermined distance apart from the first seal to form the insulated compartment. The insulated compartment contains a pressurized gas and a surface temperature of the insulated compartment is less than a surface temperature of the product compartment after the pouch is heated.

The method of forming a flexible pouch having an insulated compartment and a product compartment for packaging a product includes the steps of forming a body of the pouch from a panel of material. The method also includes the steps of applying a first insulating compartment seal having a predetermined shape to the pouch body and applying a second insulating compartment seal having a predetermined shape to the pouch body and spaced a predetermined distance apart from the first insulating compartment seal to form an insulated compartment that is separate from a product compartment. The insulated compartment contains a pressurized gas and the product compartment contains a product. The method further includes the steps of applying an opening means for accessing the product to the pouch body.

One advantage of the present invention is that a flexible pouch and method of making a flexible pouch with an integral insulated compartment is provided. Another advantage of the present invention is that a flexible pouch and method of making a flexible pouch is provided that utilizes a laminate material which includes PET foil cast polypropylene. Still another advantage of the present invention is that a method of making a flexible pouch is provided that applies a low heat seal and a high heat seal spaced a predetermined distance therefrom the first seal to form an integral insulated handle compartment. A further advantage of the present invention is that the insulated handle compartment is cooler to the touch than other compartments after the pouch is heated. Yet a further advantage of the present invention is that the flexible pouch with an insulated handle compartment is cost effective to manufacture. Yet a further advantage of the present invention is that the flexible pouch may include multiple compartments with a product contained in the various compartments.

Other features and advantages of the present invention will be readily appreciated, as the same becomes better understood after reading the subsequent description taken in conjunction with the accompanying drawings.

DETAILED DESCRIPTION OF THE PREFERRED EMBODIMENTS

Figure 1:
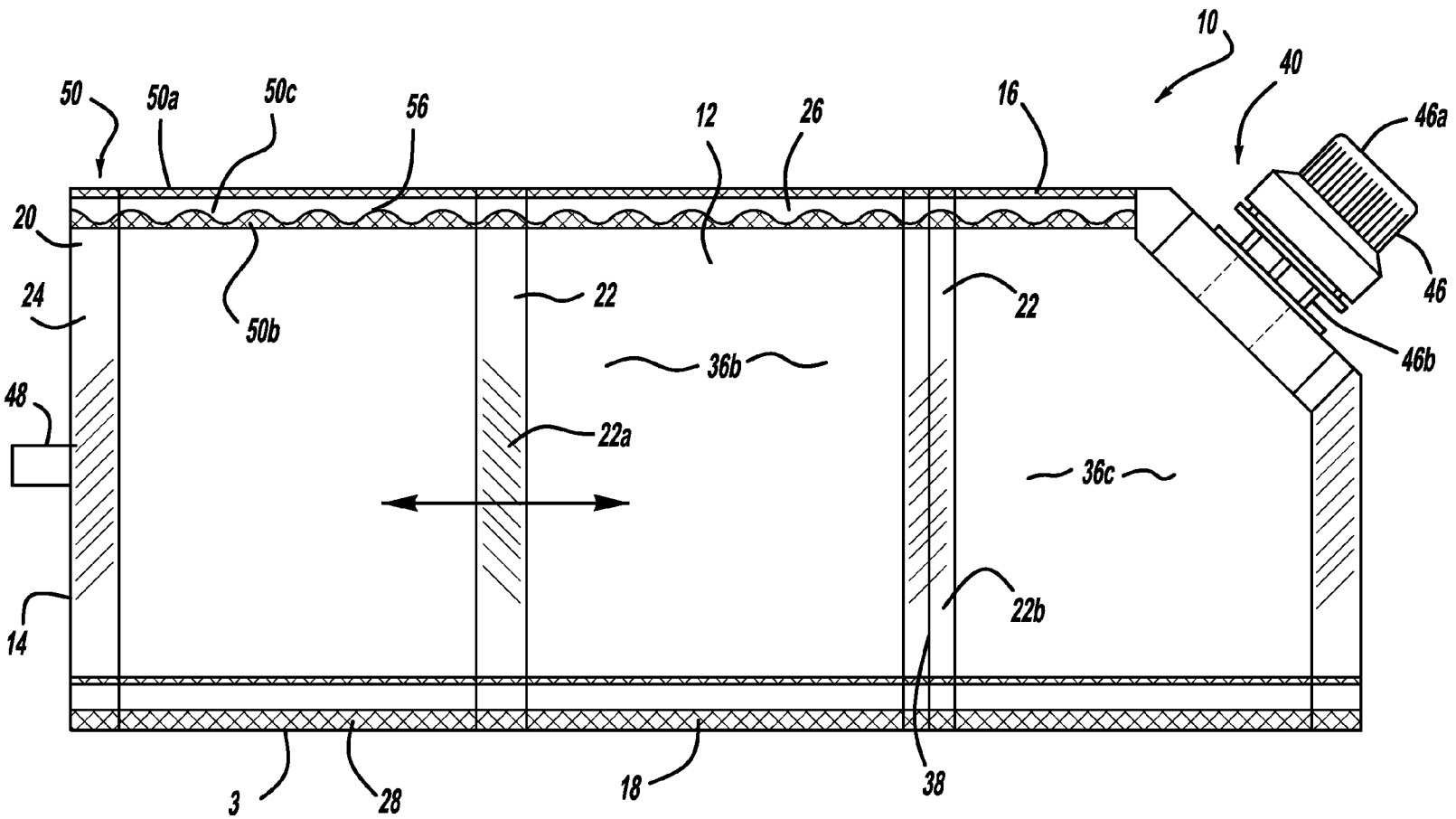
FIG. 1 is a front view of a multi-compartment flexible pouch with an insulated compartment, according to the present invention.

Referring to FIGS. 1-6 and 11*a*-14, a sealed, flexible pouch 10 for a product is illustrated. The type of product is unlimited, as well as the form of the product, such as a solid, liquid or gaseous form. The product may be a food or non-food product. The product may be a liquid which is carbonated, or one to which carbonation is added. The product may be heatable, in order to heat the contents contained therein or freezable. The pouch may contain a single serving of a product, or multiple servings. In addition, the pouch may contain one or more products. Accordingly, the flexible pouch may include one or more compartments, and one compartment is an insulated handle. Each compartment of the pouch 10 may have a different use. A compartment may be filled with a product, and multiple compartments may each contain a different product. It is also contemplated that the content of each of the compartments can assume a different form (i.e. solid, or liquid, or gas).

Various examples of pouches are described by way of illustration, and others are contemplated. In an example of a two-compartment pouch, one compartment contains a product shown in FIG. 1, and a second insulated compartment contains a gas. In another example of a two compartment pouch, each of the compartments may contain a food item that is stored separately and then mixed together for serving. In still another example of a two-compartment pouch having a frangible seal therebetween, the product in each compartment may be a chemical that is stored separately and mixed together to provide a heat pack or cold pack. In a further example of a three-compartment pouch, the product in one compartment is a product to be heated, and the other two compartments each contain a chemical that upon mixing undergoes an exothermic reaction to produce heat. An example of a chemical is an exothermic powder such as lime. Alternatively, the product is to be cooled and the other compartments each contain a chemical substance that upon mixing undergoes an endothermic reaction to produce cooling. An example of a chemical is glycol. In another example of a three-compartment pouch, one compartment is an insulated handle, and the other two compartments contain a product. In an example of a four-compartment pouch, two of the compartments may contain related products, and that the other two compartments contain products that produce a thermal reaction upon mixing. In another example of a four-compartment pouch, one compartment is an insulated handle, and the other three compartments contain a product. Advantageously, the number of compartments and content of the compartment is determined by the specific use of the package and product, and such use is unlimited.

The flexible pouch may be formed on various types of machines, such as a form machine, or a form-fill-seal machine. The flexible pouch 10 is preferably formed from a roll of preprinted material or extruded laminate layers. The laminate or extruded material is typically a three, or four, or five gauge material. The outer layer is usually preprinted. Alternatively, at least a portion of the material may be not printed, i.e. translucent, in order to view the contents contained therein. The clear portion could also be in a gusset or insert.

The choice of sheet layer material is nonlimiting, and the selection is influenced by factors such as the product contained in the pouch, the shape of the pouch, or the anticipated use of the pouch. One example of a laminate material structure includes at least one layer of virgin polyethylene terephthalate (PET), at least one layer of aluminum foil and another layer such as EVOH, PET, polyethylene or nylon or the like. Another type of laminate material structure may also include a metalized foil paper layer laminated to a cast polypropylene layer and another layer of PET, polyethylene or EVOH. Similarly, the laminate structure may include a cast polypropylene (CPP) layer, a polyethylene (PET) layer, a foil (AL) layer, a nylon (ONO) layer and another CPP layer. Another structure is the use of nylon, foil, nylon and cast polypropylene (ONO/AL/ONO/CPP) or CPP/NY/AL/CPP or PET/AL/nylon/CPP. Material structures that include CPP are well-suited for packaging a beverage, such as beer, wine or other carbonated products, to add strength to the walls of the pouch, preserve the carbonation, and protect the AL layer from cracking. Carbonation is beneficial since it acts as a microbiocide and preserves the flavor and aroma of particular products. The use of cast polypropylene laminate material also assists in retaining the filled shape of the container, even as the product is removed from the pouch 10. This is advantageous since it allows the pouch 10 to assume various shapes such as cylindrical, although other shapes are contemplated. A further example of a laminate material structure is CPP/AL/ONO/PE. This structure works well when the product has a short shelf life, and the nylon eliminates stretching or cracking of the AL layer.

The pouch is constructed from one or more panels of material by joining together corresponding edges to form the body of the pouch. The formed pouch has a front wall 12 and a back wall 14. Each wall 12, 14 is further defined by an upper edge 16, an opposed lower edge 18, and first and second side edges extending therebetween the upper and lower edges 16, 18. In an example of a pouch formed using a single panel of material, the side edges of the panel are joined along a center seam, as shown at 24. In an example of a pouch formed using two sheets of material, the corresponding side edges of each panel are joined to form two side seams. The corresponding upper edges 16 of the pouch are sealed to form an upper seam 26. Similarly, the corresponding lower edges 18 of the pouch are sealed to from a lower seam 28. The formed seams may be a flat seam, as described in commonly assigned U.S. patent application Ser. No. 11/195,906, or a "fin" type seam, or any other type of seam. The above described seams may be formed from one or more seals, in a manner to be described.

In this example, the pouch 10 has a generally rectangular shape, although other shapes are contemplated. The choice of shape for the pouch is influenced by the product contained within the package and the use of the package. The pouch may be a stand-up pouch. In addition, an edge, such as the second side edge, may include an angled portion.

The pouch 10 may include a shaping mean 30, such as an insert 34, sidewall or gusset 32. The shaping means advantageously directs the shape of the pouch 10. It may also have a functional purpose, such as to allow the pouch stand upright, or provide a base for an opening means. For example, a sidewall may be formed as a gusset or pleat. The gusset 32 may be integrally formed in the wall, or a separate piece of material. The gusset 32 may be disposed between the side edges of the front and back walls 12, 14, the lower edges, the upper edges, or any desired combination. It should be appreciated that the shape of the gusset 32 is nonlimiting. For example, the gusset 32 may be generally wider at one end and taper upwardly towards the opposite end. The gusset 32 may also be of a uniform width. The use of the gusset 32 may be functional, i.e. it may allow the pouch 10 to acquire another shape, such as cylindrical, or to stand upright. The gusset 32 also enhances the strength and rigidity of the pouch 10 during filling and processing. A side gusset is advantageous since it allows the walls of the pouch to expand as the internal pressure within the pouch increases. A gusset 32 positioned between the lower edges of the pouch 10 forms a base, which may enable the pouch 10 to stand upright.

Figure 5A:
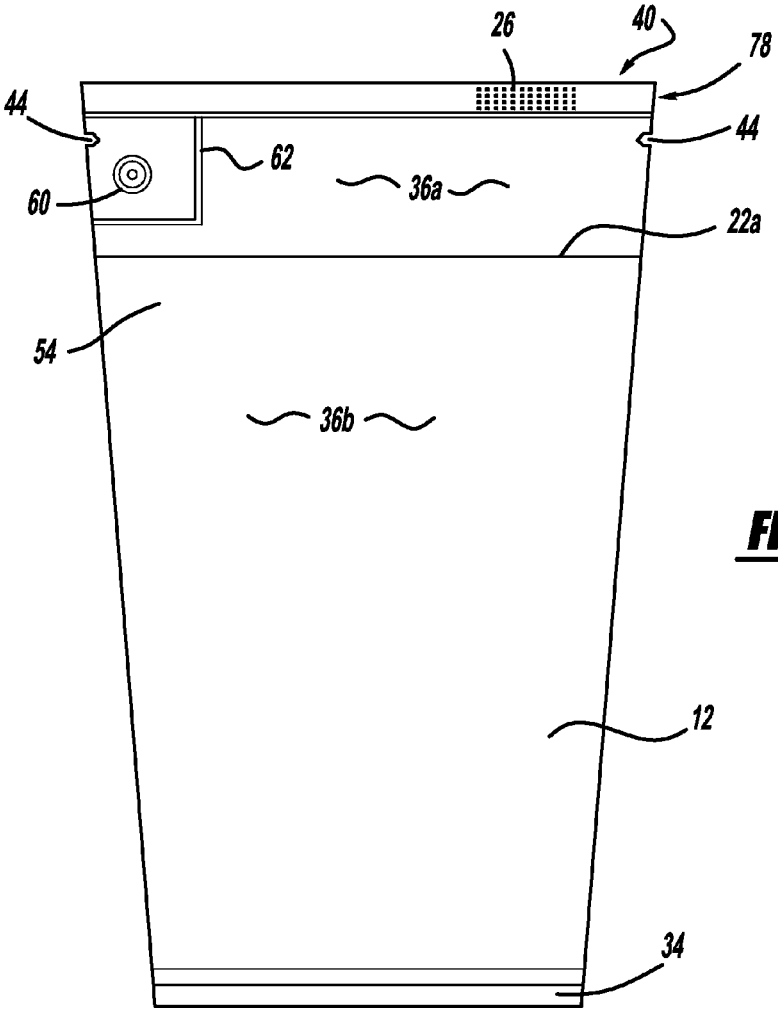
FIGS. 5*a*, 5*b* are front views of another example of a multi-compartment flexible pouch with a venting means, according to the present invention.
Figure 5B:
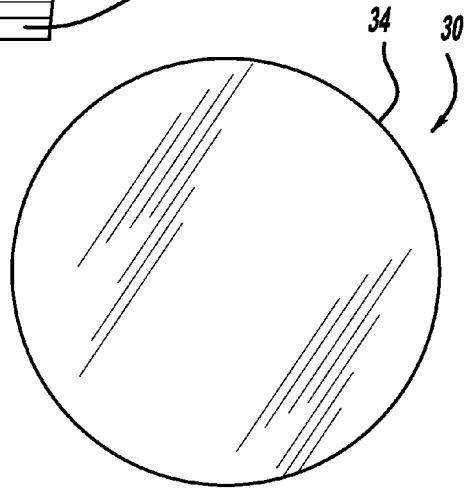

Similarly, the pouch may include an insert 34 as shown in FIGS. 5*a*, 5*b*. The insert 34 is a generally planar member that is inserted between the walls 12, 14 of the pouch 10. The shape of the insert 34 is nonlimiting, and generally influences the shape of the flexible pouch. The insert 34 may be positioned internally within the pouch or externally. Various materials may be utilized for the insert, such as foil, cardboard, plastic, nylon, laminate or the like. Further, the insert 34 may be formed from a printed material, or it may be clear. In one example, the insert 34 is inserted between the lower edges of the panel and sealed to the walls of the panel. The seal may be an ultrasonic seal or a heat weld or the like. The insert 34 may provide a support for an opening means, such as a fitment.

The pouch may contain two inserts, such as a first insert positioned between the lower edges of the panel, and a second insert positioned between the upper edges of the panel. The first insert may include an integral opening means, such as a straw hole for receiving a straw. The pouch of this example has a generally square shape.

The pouch 10 may divided into multiple compartments 36 by a seal. The seal may be any type of seal, such as a heat seal, or frangible seal, or an insulating seal or the like. The compartment formed between seals may contain a product or serve as an insulator. It should be appreciated that the number of compartments 36 is nonlimiting. It should also be appreciated that any arrangement of compartments 36 is contemplated. It should also be appreciated that the compartments 36 may be of varying sizes. Also, the compartments 36 can be arranged side-by-side horizontally or vertically, or any combination thereof. A mid-seal 22 separating compartments containing a product can have a generally horizontal orientation, or a generally vertical orientation. The mid-seal 22 advantageously isolates one compartment 36 from an adjacent compartment 36. Preferably, the mid-seal 22 is positioned so that it does not interfere with filling of the pouch. In an example, the mid-seal 22 may include a score line 38 that facilitates folding over the compartments of the pouch along the score line 38, if so desired. The score line 38 does not affect the integrity of the mid-seal.

In another example, the mid-seal 22 may be a frangible seal 22*a*. Advantageously, the frangible seal can be broken and the contents of each compartment may be mixed. The frangible seal 22*a* is a seal with a predetermined burst pressure that is less than the burst pressure of the other seals, such as the side seal 24, upper seal 26 or lower seal 28. The frangible seal 22*a* may be broken when the pressure within the compartment 36 exceeds a predetermined burst pressure value, such as occurring when the pouch is folded along the frangible mid-seal 22*a*.

The frangible seal is formed using a sealing technique that involves the application of heat and pressure, such as a heat weld, or by an ultrasonic seal. The frangible seal may be formed by reducing sealing temperature to a lower setting, such as a reduction of about 60° F., or a temperature just above the melting point of the sealant layer. The frangible seal may also be formed by reducing the pressure of the seal bars to create a tack seal. A further technique is to reduce both the pressure of the seal bars and the time of applying the seal bars.

Figure 6:
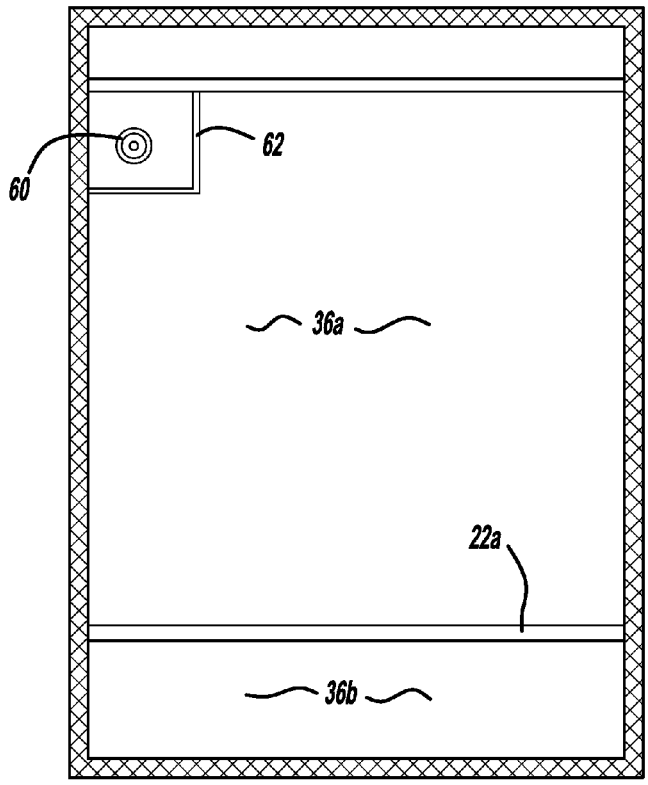
FIG. 6 is a front view of still another example of a multi-compartment flexible pouch with a venting means, according to the present invention.

In the example illustrated in FIGS. 5*a* and 6, one horizontally oriented mid-seal 22 separates a first compartment 36*a* from a second compartment 36*b*, and this mid-seal is a frangible seal 22*a*. In another example illustrated in FIGS. 1-3, there are three compartments 36 and two mid-seals 22. Also, in this example, the first mid-seal 22*a* separating compartment 1 from compartment 2 is a frangible seal. The second mid-seal 22*b* separating compartment 2 from compartment 3 is a permanent seal. Alternatively, the second mid-seal could be a frangible seal if so desired. In still another example shown in FIG. 4, the pouch 10 is a four-compartment pouch. The first mid-seal separating the first and second compartments is a frangible seal. The second mid-seal separating the second and third compartments 36*c* is a permanent seal, and the third mid-seal separating the third and fourth compartments is a frangible seal.

In still another example, the first and second compartments 36*a*, 36*b* may contain products to be mixed to undergo a thermal reaction, and the third compartment 36*c* may contain a third product that benefits from the thermal reaction. For example, the first and second compartments 36*a*, 36*b* contain products that are mixed together when the frangible seal 22*a* bursts to create a heat pack. The third compartment 36*c* may be folded over the first and second compartments 36*a*, 36*b*, or folded between the first and second compartment 36*a*, 36*b*, in order to heat the third product. This arrangement may also facilitate dispensing of the third product via an opening means 40 located in the third compartment.

Referring to FIGS. 1 and 11-14, the pouch 10 may include an insulated compartment, and the insulated compartment 50 may provide a handle. The position of the insulated compartment 50 is determinable by the intended use of the insulated compartment. For example, the insulated compartment 50 may be positioned to provide an insulated handle for the pouch 10. The insulated handle compartment 50 provides a gripping surface for holding a pouch 10 by the user. Similarly, the insulated compartment 50 may be juxtaposed between compartments 36 to thermally separate one compartment from another compartment. The insulated compartment 50 may be formed along an edge of the pouch. In another example, the insulated compartment is positioned between a fitment 26 and an outermost edge 52 of the pouch.

The insulated handle compartment 50 is defined by an insulating seal that includes a first seal 50*a*, a second seal 50*b* spaced a predetermined distance apart from the first seal 50*a*, and an airspace therebetween 50*c* forming the insulated compartments that serves as an insulator. In an example, the second seal is adjacent the outermost edge 52 of the pouch. A pressurized compartment is formed between the first seal 50*a* and the second seal 50*b*. The pressurized gas within the insulated compartment 50 enables each of the walls of the pouch that define the insulated compartment 50 to have a predetermined shape, which in this example is arcuate as shown in FIG. 11*b* at 58. Either of the seals 50*a*, 50*b* used to form the insulated compartment 50 may have a predetermined shape, such as linear, arcuate, scalloped or the like, to further increase the pressure of the gas contained within the insulated compartment. In this example, the scalloped shaped inner edge of the first seal 50*a* increases the pressure within the compartment, for example, between one or two pounds. If the pouch 10 is heated, the temperature of an outer surface of the insulated handle portion of the pouch as shown at 58*a* is less than the temperature of an outer surface of the body portion of the pouch as shown at 59. The insulated compartment 50 does not absorb the heat as readily as the rest of the pouch. The insulated compartment 50 facilitates handling of the pouch 10, since the pouch 10 can be comfortably held by the insulated handle 50 due to the insulating ability of the airspace 50*c* between the seals 50*a*, 50*b*. In this example, the insulating seal has an overall width of at least ¾". For example, after heating the pouch in a microwave oven, the surface of the temperature insulated compartment 58*a* is in the range of 120° F., while the surface temperature of the other compartments 59 is in the range of 212° F.

The pouch also includes an opening means 40 for accessing the contents or dispensing the contents from at least one compartment 36 of the pouch 10. Various types of opening means 40 are known in the art for this purpose. It should be appreciated that the opening means 40 may be incorporated into the pouch 10 prior to filling the pouch 10.

Figure 2:
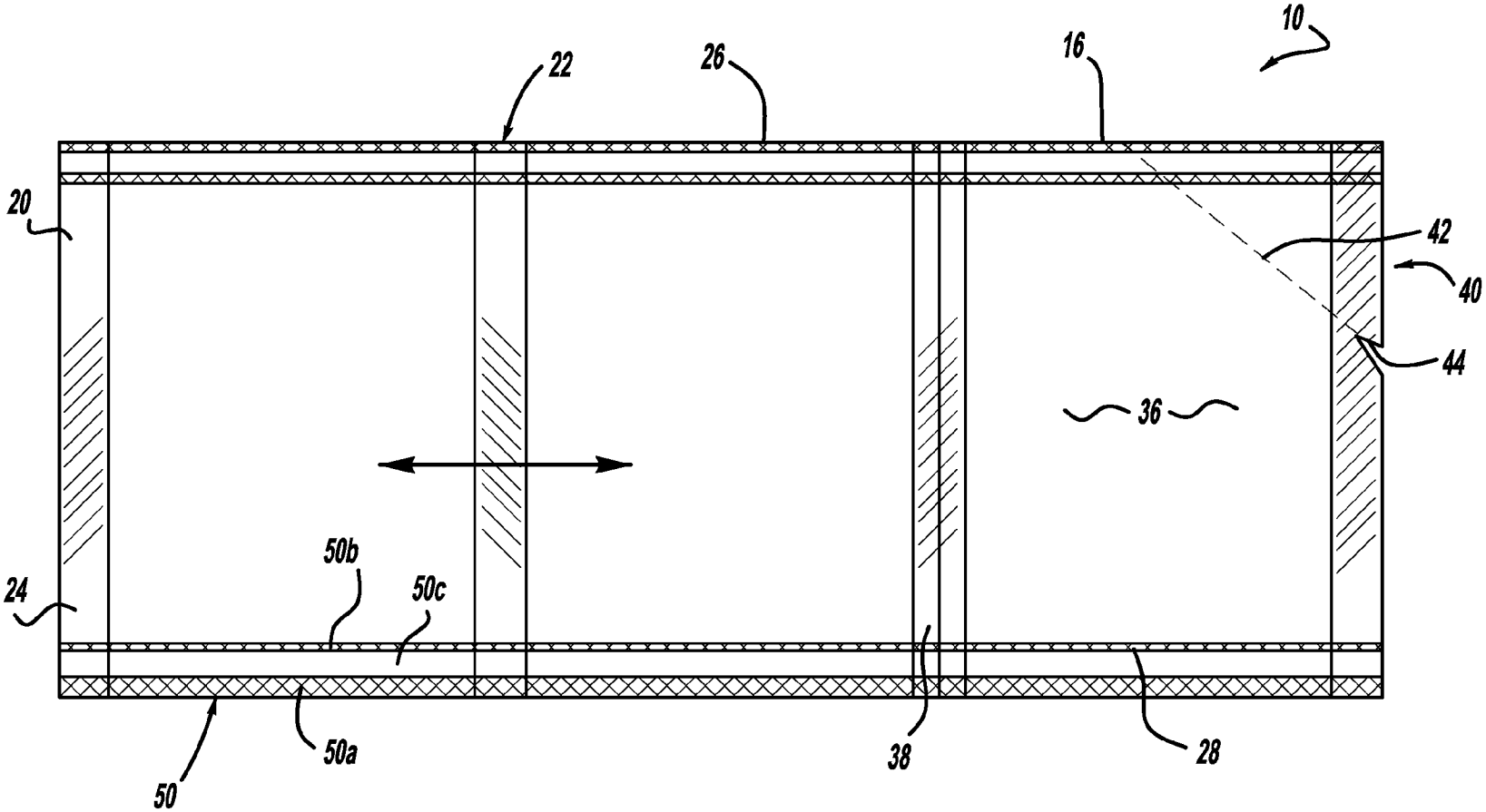
FIG. 2 is a front view of another example of a multi-compartment flexible pouch, according to the present invention.
Figure 11A:
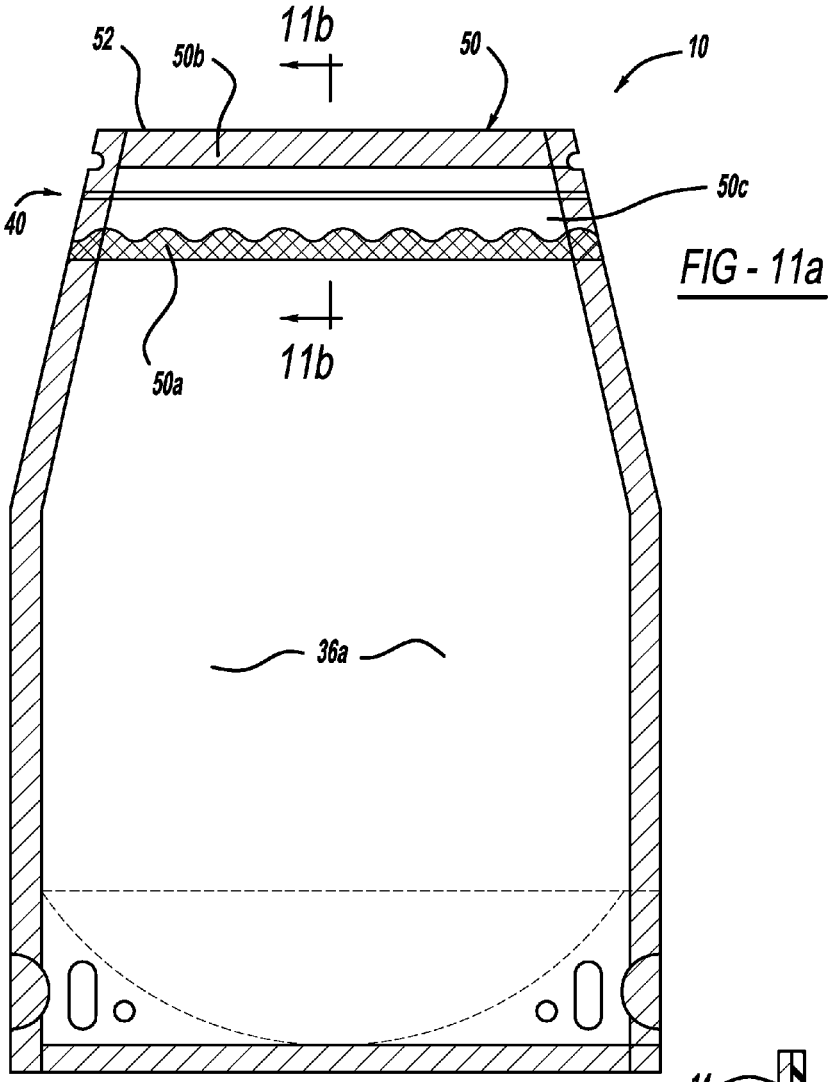
FIG. 11*a* is a perspective view of yet another pouch with an insulated compartment, according to the present invention.
Figure 11B:
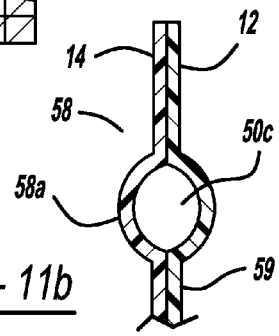
FIG. 11*b* is a sectional view through B-B of the insulated compartment of FIG. 11*a*, according to the present invention.
Figure 12:
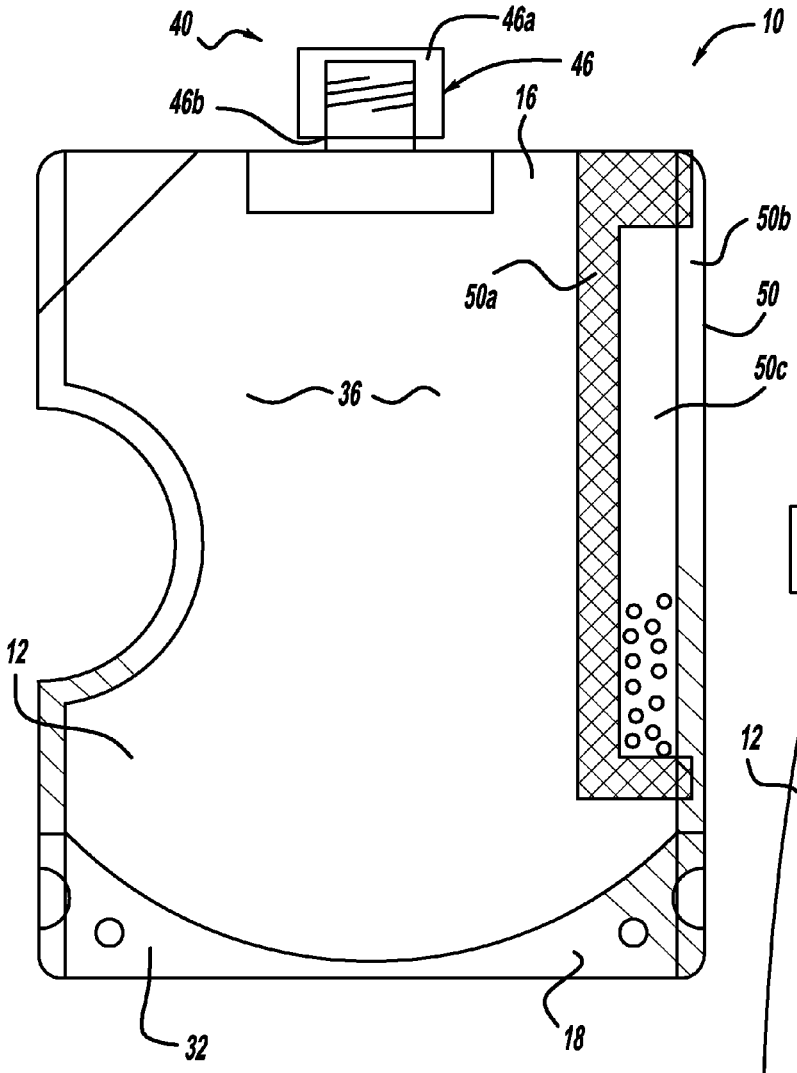
FIG. 12 is a perspective view of a further pouch with an insulated compartment, according to the present invention.
Figure 13:
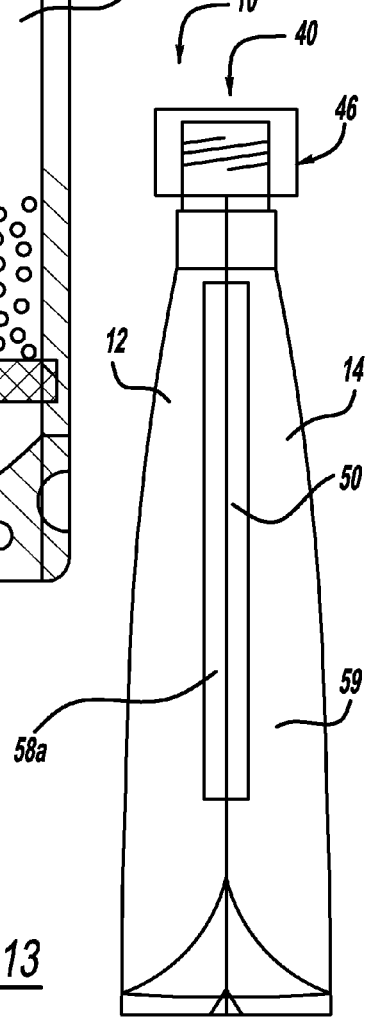
FIG. 13 is a side view of the pouch of FIG. 12, according to the present invention.
Figure 14:
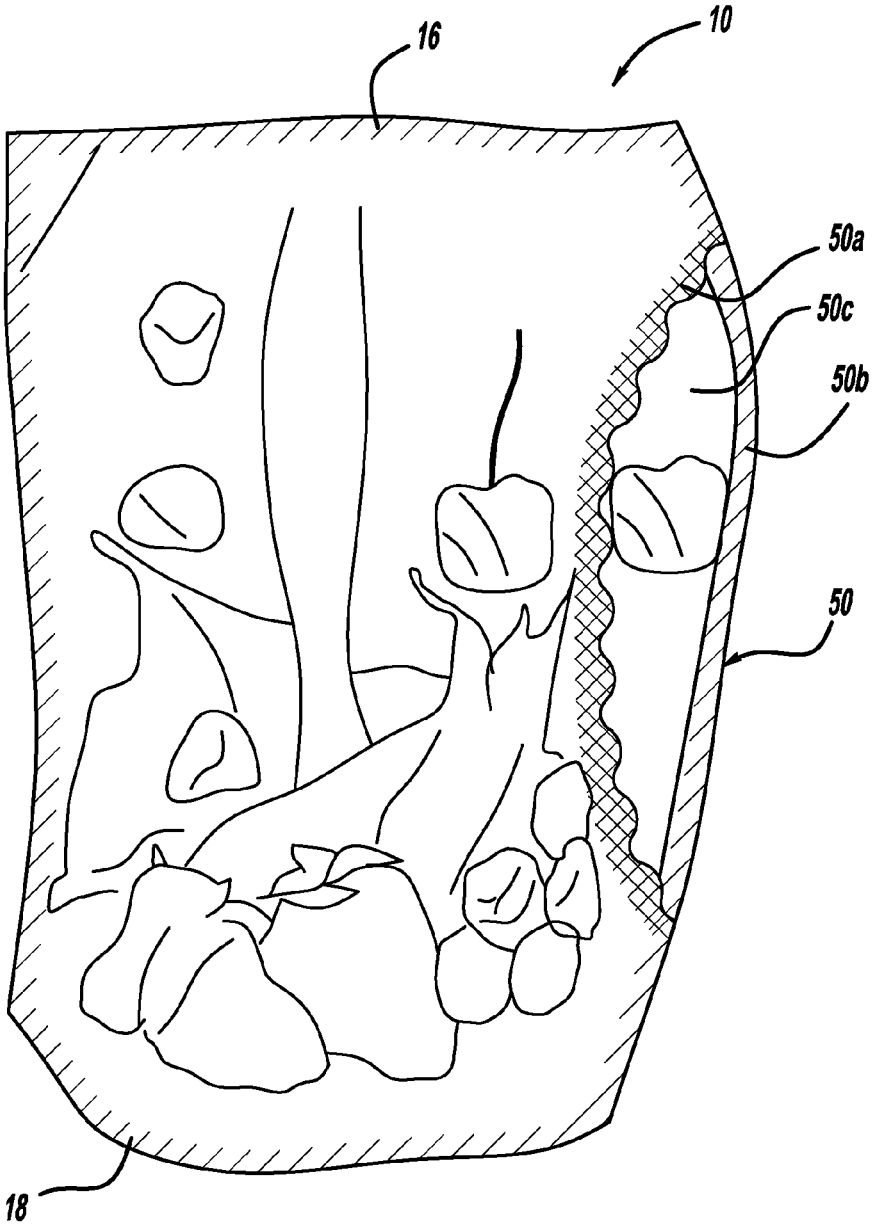
FIG. 14 is a perspective view of still yet another pouch with an insulated compartment, according to the present invention.

One example of an opening means is a tear-off portion, as shown in FIG. 2 or FIG. 11*a* at 42. The tear-off portion 42 provides access to at least one of the compartments 36. The tear-off portion 42 usually has an integral tear notch 44. The tear notch 44 is typically formed near the upper edge, for accessing the product contained therein although it could be located elsewhere. Another example of an opening means 40 is a weakened, straw-pierceable portion in the pouch for receiving a straw within at least one of the compartments. A further example of an opening means 40 is a pull tab covering an opening in the pouch. Again, the pull tab provides for access to at least one of the compartments. Yet another example of an opening means is a resealable zipper, such as a hermetic seal, such as a zipper that is sold under the name TopTite™ (not shown).

Figure 3:
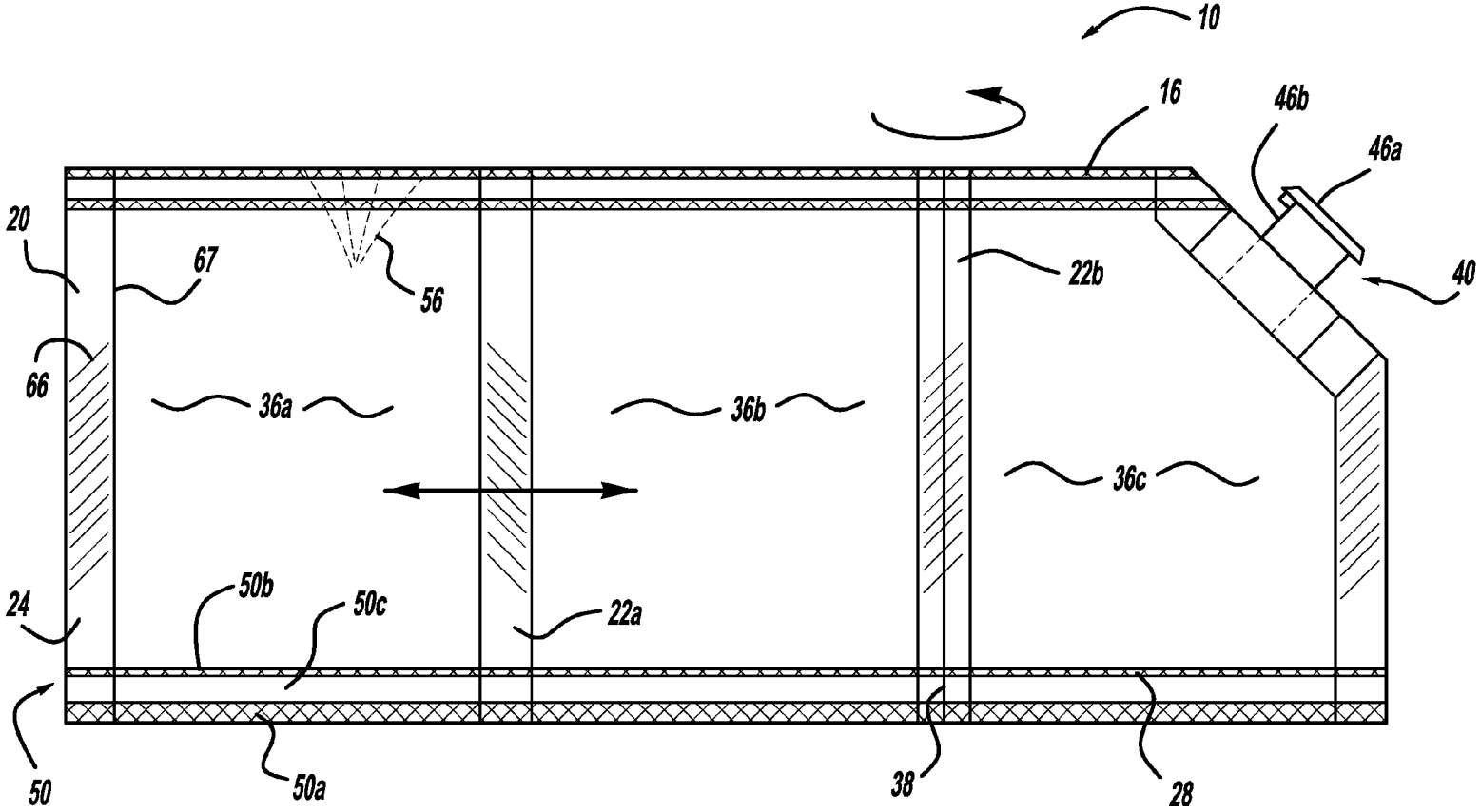
FIG. 3 is a front view of yet another example of a multi-compartment flexible pouch, according to the present invention.

Still a further example of an opening means 40 is a fitment 46, such as a removable and replaceable cap 46*a* secured to a spout 46*b*. The fitment 46 may be mounted to the top portion or side portion of the compartment 36 containing the product to be dispensed. In FIG. 1, the fitment 46 is a screw-off cap 46*a* with a pour spout 46*b*. FIG. 3 illustrates a flip-top cap secured to a pour spout 46*b*. The cap 46*a* can be the traditional round shape. Alternatively, the cap 46*a* can have an elongated oval shape so that the pouch may stand up on its own. The cap 46*a* and spout 46*b* can be made from a variety of materials. For example, the cap 46*a* may be made from plastic, such as reground resins. The spout 46*b* may be made of polypropylene (PP), depending on the product. The fitment 46 is sealed between the edges of the panel using a sealing means, such as an ultrasonic seal or a heat weld, or the like. The spout portion of the fitment 46 may include a removable seal (not shown) to prevent leakage of the product or evidence of tampering.

One of the pouch compartments 36 may include an integral vent means 60, as shown in FIGS. 5 and 6. The vent means, such as a valve, is preferably positioned in an upper portion of one wall of the compartment, such as the front wall 12 of this example. The valve 60 is preferably welded in an aperture formed in the panel during the flexible pouch forming process. The valve 60 functions to exhaust gas, such as steam. The gas may be formed within the package while heating the product contained within the compartment 36. The valve 60 may also be operable to respire gas formed in the compartment 36 for other reasons, such as gas formed by decaying food or during freezing or the like. The valve 60 remains tightly closed, until pressure from the gas, such as steam, reaches a predetermined pressure value. An example of a predetermined pressure is approximately 3 mbar. The valve 60 opens and remains open, to release the gas from the package in a controlled manner.

Various types of valves 60 are contemplated. For example, a tape may be used to cover a hole in the wall. Alternatively, a pressure relief device, such as that manufactured by PPI Technologies, Sarasota, Fla. model number P00T, may be utilized. Another example of a valve is disclosed in commonly assigned U.S. patent application Ser. Nos. 10/228,430 and 10/967,547 and PCT Patent Application No. PCT/US2004/34361.

The valve 60 is completely enclosed by a frangible valve seal 62 formed in the walls of the pouch. The frangible valve seal 62 is designed to burst when subjected to a predetermined frangible seal bursting pressure. The frangible valve seal 62 advantageously isolates the valve 60 from the contents of the pouch. The valve 60 and frangible valve seal 62 are preferably positioned so as not to interfere with filling or sealing of the pouch 10. The frangible valve seal 62 is automatically broken when the pressure in the pouch 10 exceeds a predetermined bursting value, such as occurring when the pouch 10 is heated above a predetermined temperature. In one example, the frangible valve seal 62 is broken due to the pressure buildup of steam within the compartment 36, thus allowing the steam to escape through the valve. In another example, the pressure can be increased by manipulating the pouch 10 in order to break the frangible valve seal 62.

In the example shown in FIGS. 5 and 6, the frangible valve seal 62 has an "L" shape, although other shapes are contemplated. The valve seal 62 of this example is preferably positioned so that the side seal 24 serves to enclose the open end of the "L" shaped valve seal 62. Other shapes for the frangible seal 62 are contemplated, such as a "V-shape", or a circle, or a square, or the like.

As shown in FIG. 5, the product is a food product such as soup. One compartment of the pouch includes a vent means 60 surrounded by a frangible valve seal 62. This compartment may be separated from other compartments by a mid-seal 22 that provides a barrier, the other compartments may include a product that when mixed produces heat to heat the soup. As shown in FIG. 6, a first compartment 36*a* contains the vent means 60 and the vent means is separated from a food product, such as a vegetable, by a frangible seal 22*a*. The second compartment 36*b* contains a product such as water, and the mid-seal is a frangible seal. In operation, increasing the pressure in the pouch 10, such as by squeezing the pouch, causes the mid-seal 22 to burst, so that the contents of the first and second compartment are mixed together. The pouch may be heated, such as using an external source, causing the frangible valve seal 62 around the vent means 60 to burst, thus allowing the escape of gas from the pouch 10.

It should be appreciated that the flexible pouch may advantageously include other features that are known in the art. One example of a feature is an integrally formed label 54 as shown in FIG. 5. The label 54 may be formed from an outer layer of the laminate material that includes preprinted information. The label 54 may also be a sleeve covering the outer surface of the pouch. The sleeve may cover only a portion of the pouch outer surface. Preferably, the sleeve is heat shrunk over the outer surface of the pouch. This operation may occur either before or after filling of the pouch with product. The sleeve is advantageous since it adds one more layer of material to strengthen the pouch and improve its durability. Various types of material may be utilized for the sleeve, such as paper or a plastic, and the selection is nonlimiting.

Another example of a feature is an integrally formed securing means 48, such as a tape, for securing the compartments 36 together. For example, two of the compartments may be sealed together to create a heat pack or cold pack around the product contained in another one of the compartments.

A further example of a pouch feature is a guide pocket 56 formed in a panel or wall of the pouch 10 prior to filling and sealing, to facilitate the separation of the front and rear panels prior to the filling of the pouch 10. Preferably, each compartment 36 would contain a guide pocket 56. An example of a pouch with a guide pocket is disclosed in commonly assigned U.S. patent application Ser. No. 10/310,221.

After the pouch 10 is formed, the pouch 10 is available for filling, such as through an opening formed between open edges of the panels, or through the fitment. After filling, the open edges of the pouch are sealed using a conventional method, such as heat sealing, or ultrasonic sealing or the like. The closing seal may be a single seal, or a wide double seal, as previously described. The sealed pouch is finished. For example, the pouch may be trimmed so that the compartment containing the product is smaller than the other compartments. This is advantageous when the compartment with the product is positioned relative to the pouch containing the thermal materials.

In operation, the pouch may be manipulated to utilize the product contained therein. The pouch may be cooled or heated, or folded or separated or the like. The insulated air handle 50 formed by a compartment facilitates use of the pouch. In an example of a four-compartment pouch shown in FIG. 4, a product contained in one pair of compartments undergoes a thermal reaction when mixed, and another compartment contains a product intended to be mixed. Each pair of compartments may be separated by a permanent seal, so that the products are kept separate. Within each pair of compartment, a frangible seal separates each compartment, allowing contents of within each pair of compartments to be mixed together. Similarly, one of the compartments forms an insulated compartment. For example, one compartment may contain coffee grounds and the other may contain water to make coffee when mixed together, and another compartment may contain chemicals that produce heat when mixed together. One compartment of each is folded along the respective frangible mid-seal, in order to break the frangible seal. The contents of the adjacent compartments are mixed together after the seal separating them is broken. The compartments are folded together in order form a compact package for drinking the coffee. The package may be comfortably held by the insulated compartment.

Similarly, in an example of a three-compartment pouch with a horizontal arrangement of compartments as shown in FIGS. 1-3, one compartment may be folded in order to break a frangible mid-seal to mix the contents of the two adjacent compartments. Another compartment, separated from the other two by a solid mid-seam, may be positioned between the first and second compartments, or adjacent the second compartment. In this example, the mixed contents undergo an exothermic reaction, creating heat, which may be utilized to heat the contents of the third compartment. In another example, the mixed contents may undergo an endothermic reaction, which may be utilized to cool the contents of the third compartment. In a further example of a two-compartment pouch with a vertical arrangement of compartments as shown in FIGS. 5 and 6, a lower compartment may contain water, a middle compartment contains a powder, and an upper compartment contains a catalytic product. A frangible seal separates each of the compartments. When the seals are broken, the products are mixed, resulting in the production of oxygen. In an example of a pouch with an insulated handle compartment, the handle can be comfortably gripped, despite any thermal reaction the pouch is subject to. It should be appreciated that the multi-compartment flexible pouch may have many other uses and features other than those described herein.

Figure 7:
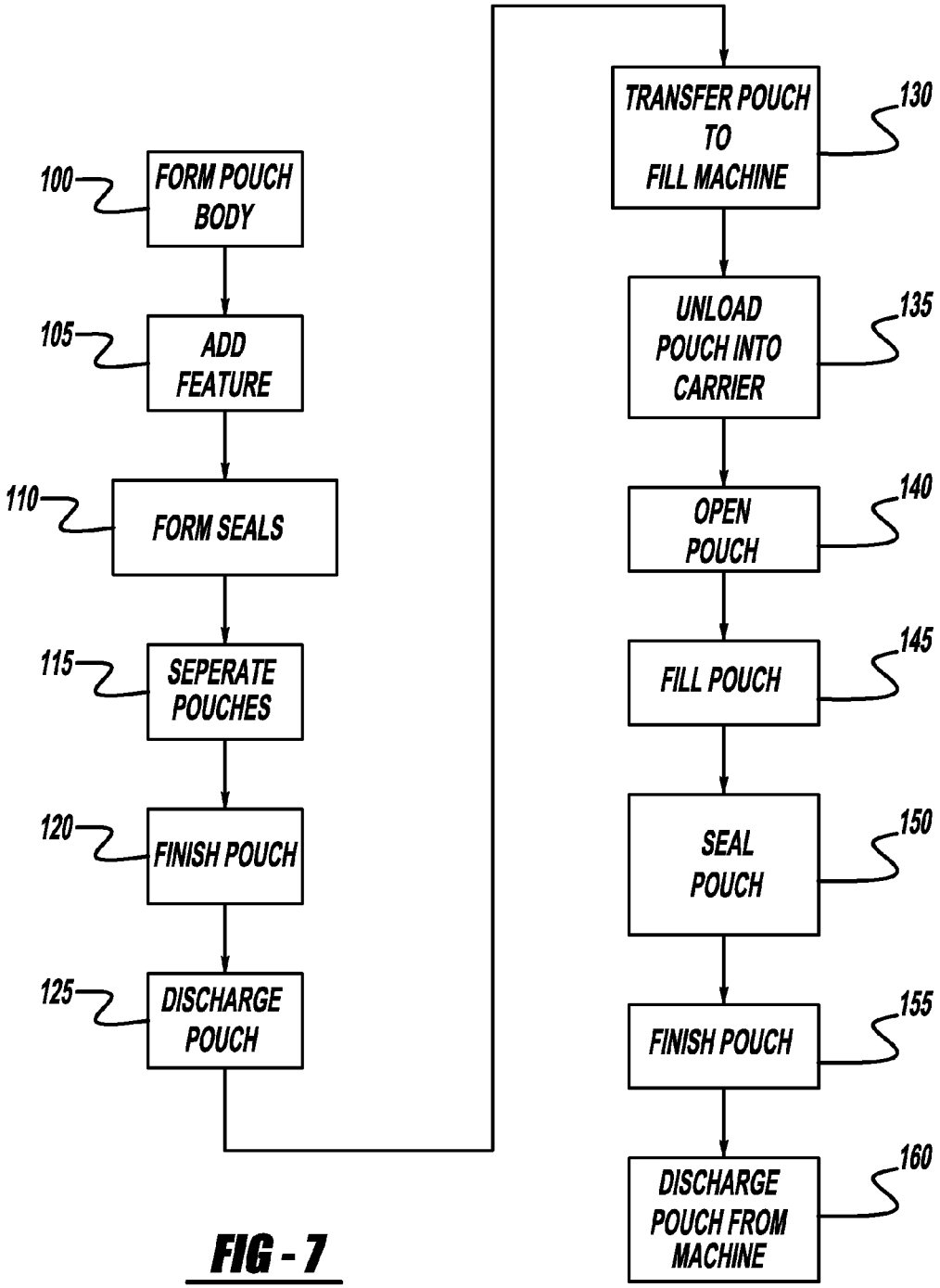
FIG. 7 is a flowchart illustrating a method of manufacturing and filling the flexible pouch of FIGS. 1-6, according to the present invention.

Referring to FIG. 7, a method for forming and filling the multi-compartment flexible pouch 10, such as that described with respect to FIGS. 1-6 and 11*a*-14, using a high speed machine is illustrated. The method begins in block 100 at a first station with the step of forming the body of the pouch. Each pouch 10 has a predetermined shape. For example, a roll of a preprinted laminate material as previously described, is unrolled along a horizontally oriented plane. The initial width of the roll of material is determined by the desired finished size of the pouch and the number of pouches to be obtained from the width. For example, three or four or six pouches representing six to twelve wall panels can be obtained from a width of the roll of material on a three-lane machine or four-lane machine, respectively.

Each wall panel has an inner surface and an outer surface. One layer of the material is preferably preprinted with information or locating indicia (not shown), such as a registration mark. The registration marks are located on the material to denote an edge of a panel. The registration marks are read by an optical reading device (not shown), such as a scanner, to index the material in a predetermined position at the cutting station. The preprinted information may include labeling information that describes the product contained within the pouch, or instructions on how to use the pouch. In this example, the layer of preprinted information is located on an outer layer of the material.

Figure 8:
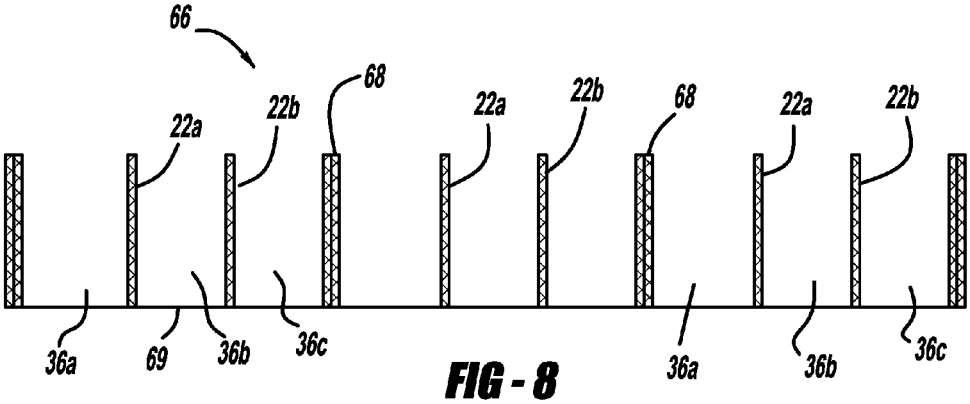
FIG. 8 is an elevational view of a web of material, according to the present invention.

Various techniques may be utilized to form the body portion of the pouch, depending on the desired end shape of the pouch. The pouch may be formed from one panel sheet of material or two panels, as shown in FIG. 8 at 66. An example of a prefabricated pouch forming machine is the Nishibe SMB500, SMB600 or SMB700. Another example is the Laudenberg form-fill-seal machine, FBM 10, 54, 20, 22. Preferably, several pouches are formed from one width of material. The material is removed from the roll, and may be cut into sections that are positioned to form the front wall and rear wall of the pouch. The methodology advances to block 105.

In block 105, a feature may be added to the pouch. For example, shaping means 30 such as a gusset 32 or insert 34 may be positioned between the aligned first and second unrolling sections of material. Alternatively, the gusset or pleat is formed in the panel using a folding operation. The insert 34 may be positioned at any edge, such as a lower edge of the pouch or an upper edge. More that one insert 34 may be utilized to achieve a desired shape.

In addition, an opening means 40 may be applied at this time. For example, an opening means 40 such as a press-to-close zipper may be positioned between the walls 12, 14. Another opening means such as a straw hole, patch or tear notch 44 may be formed. The methodology advances to block 110.

In block 110, a seal is applied to the pouch in a sealing operation. For example, as shown in FIG. 8 for a web of material, edges of the pouch 10, such as the designated side edge 20 and lower edge 18, are joined together in a sealing operation. One edge may be left open, designated as the upper edge 16, in order to fill the pouch. The seal may be a heat weld, ultrasonic seal, or a combination thereof. It should be appreciated that the seal may be applied to any one of the edges. In addition, a fitment may also be applied between sealed edges of the pouch. The fitment is positioned on the pouch in a variety of locations, such as mounted on the lower, upper or side portion of the pouch. Various styles of fitments are contemplated, such as the spout fitment illustrated in FIGS. 1 and 3.

In an example of a seal with reduced gas production, the side and lower edges 18, 20 are joined together using an ultrasonic sealing process using vibrational energy to form the seal or a welded seal that includes the application of heat and compression in a two-step heat welding operation. A first seal 66 is slowly tack welded with a low heat, such as 180° F. to tack the two pieces of material together, so that steam is not released containing volatile materials such as ketones, butyls, butanes, or the like. The material may include resins, such as organoleptic resins which produce an undesirable taste in the product. The first seal 66 is relatively wide, such as 6 mm.

After the slow low-heat weld, a second heat seal 67 is applied to the weld along the inner edge, and adjacent the contents. The second seal 67 has a width of approximately 2 mm, or one-third that of the first seal 66, and is heated to a higher temperature, such as 260° to provide strength.

It should be appreciated that the small width of the second seal 67 along with the relatively short heating time at approximately half of the preheat results in minimizing the gasses created during the process. The second heat seal 67 provides strength to retard the high pressure created by the sealing process. The seals 66, 67 are immediately cooled to stabilize the pouch 10.

It should be appreciated that this heat sealing process may be applied to any one of the edges 16, 18. If an opening means 40 is also applied, the process may be modified slightly. For example, if a reclosable pouch is desired, an opening means 40, such as a zipper provided by Zip Tight is applied. This type of zipper is easily opened from the outside, however, it provides resistance to pressure on the inside, and the greater the pressure on the inside, the tighter the zipper is sealed. The fitment 46 is located on the pouch 10 in a variety of locations, such as mounted on a bottom, or a top, or a side portion of the pouch. Various types of fitments are contemplated, including the spout fitments illustrated in FIGS. 1 and 3.

In an example of a mid-seal, the mid-seal is applied to the pouch wall to separate the pouch into a first and second compartment 36*a*, 36*b*. The mid-seal 22 may be a frangible seal 22*a* as previously described that prevents the product in one compartment from contaminating the product in the adjacent compartment. The frangible mid-seal 22*a* breaks open if subjected to a predetermined bursting pressure. Another example of a mid-seal 22 is a permanent seal 22*b*. This type of mid-seal is desirable when the products within the compartments are to be kept separate. The mid-seal 22 is formed using a thermosealing process that includes in the application of heat, or alternatively an ultrasonic sealing process. Preferably, the frangible mid-seal 22*a* is formed at a lower temperature and pressure than a permanent seal. In an example of a multi-compartment pouch, the first mid-seal is a frangible seal and the second mid-seal is a permanent seal.

In an example of an insulating seal 50, the insulating seal is applied to a portion of the pouch to form an insulated compartment. The insulating seal 50 includes two seals 50*a*, 50*b* separated by an airspace 50*c*. The airspace 50*c* creates a pocket of pressurized air that creates an insulated handle compartment. Various sealing techniques are known in the art. For example, the first seal having a predetermined shape is applied, such as to the edge of the pouch. The second seal, also having a predetermined shape, is spaced apart from the first seal. The pressure created by the shaped edge of the seals forces the walls of the pouch outwardly to acquire an arcuate shape between the first and second seals. The increased pressure in the space between the first and second seals creates the insulated handle. For example, the pressure in the insulated handle compartment is in the range of one to two pounds.

In block 115, the individual pouches formed in the roll width of material are separated from each other in a cutting operation. For example, each section of material may be first separated along its width, i.e. along the side seams of the pouches, as shown in FIG. 8 at 68. The section is then is separated into individual pouches along a cutting line, as shown at 69. In this example, the width of unrolling material represents the side edges. The material is cut into a pouch 10 using a known cutting apparatus, such as a laser or punch or the like. The cutting apparatus imparts a single cut in the material to separate the pouches. The length of the pouch 10 is controlled by the distance between the cuts. For example, a width of the web of material 66 may contain three multiple-compartment pouches. A single widthwise and lengthwise cut separates the web into individual pouches.

Alternatively, two rows of pouches are cut out at one time by adding a double cut between two lengthwise cuts, preferably in the center. Advantageously, forming two pouches during the cutting operation effectively doubles the assembly line speed.

It should be appreciated that the upper edge 16 or lower 18 edge may be further trimmed in a trimming operation. For example, the end of the pouch may be trimmed to accommodate the fitment. In another example, two legs are formed during the trimming operation in order to recess the fitment, when the fitment is sealed to the pouch. Further, the pouch may be trimmed to obtain a predetermined final pouch shape.

An opening means 40 may alternatively be added at this time. For example, a fitment 46, as previously described, may be sealed within the walls of the pouch. The fitment 40 may be located on the pouch 10 in a variety of locations, such as mounted on a bottom, or a top, or a side portion of the pouch. Various types of fitments or opening means are contemplated, as previously described.

Figure 4:
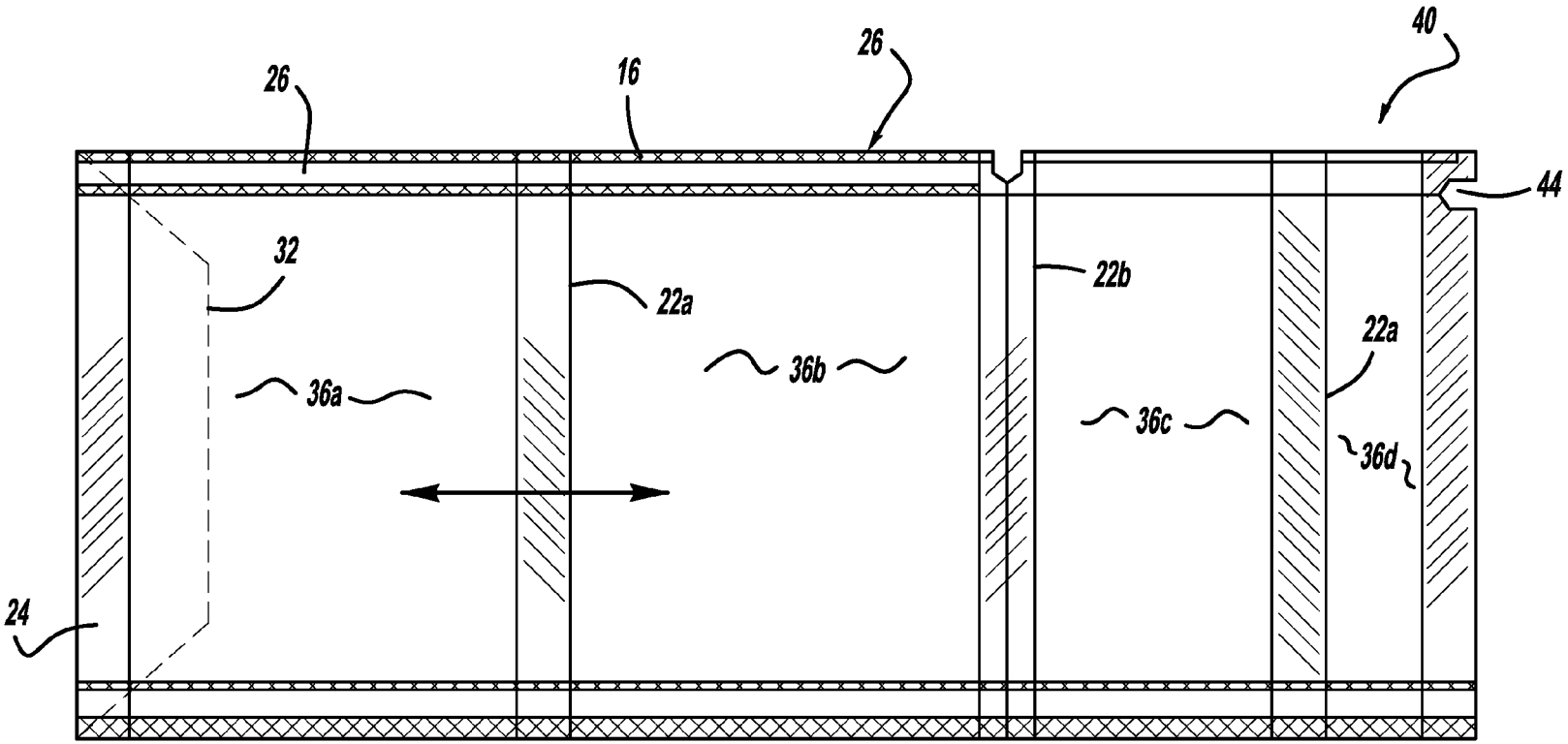
FIG. 4 is a front view of a further example of a multi-compartment flexible pouch, according to the present invention.

Using the example of a fitment located in a corner of the pouch as shown in FIGS. 1 and 4, the corner of the pouch is cut to receive the fitment. The pouch may be transferred to another machine for the insertion of the fitment, such as a HAMA-type machine. The fitment is inserted through the opening in the pouch, and attached to the pouch by heat sealing.

The methodology advances to block 120, and the pouch is then otherwise finished. In an example, the pouch is cooled. In another example, a crease or guide pocket 56 may be formed in a top portion of each compartment 36 in a creasing operation in order to facilitate opening and filling the pouch. A forming technique, such as stamping, may be utilized. Another example of a forming technique is the use of heated tubes that thermoform a crease in each panel. An example of a method of forming a crease in the compartments to facilitate opening the pouch is disclosed in commonly assigned U.S. patent application Ser. No. 10/310,221, which is incorporated herein by reference.

The methodology advances to block 125, and the pouches 10 are removed from the machine and loaded into a carrier. For example, the pouches 10 are loaded into a magazine that aligns the pouches in a predetermined position, such as an upright position. The pouches 10 may all be aligned in the same direction, or depending on the type of fitment, alternating. Preferably, the magazine is a boxlike structure. The width of the magazine corresponds to the width of the pouch 10. The magazine may include a mechanism that exerts a preload force on the pouches 10, so that the pouches 10 remain adjacent each other. The methodology advances to block 130.

Figure 10:
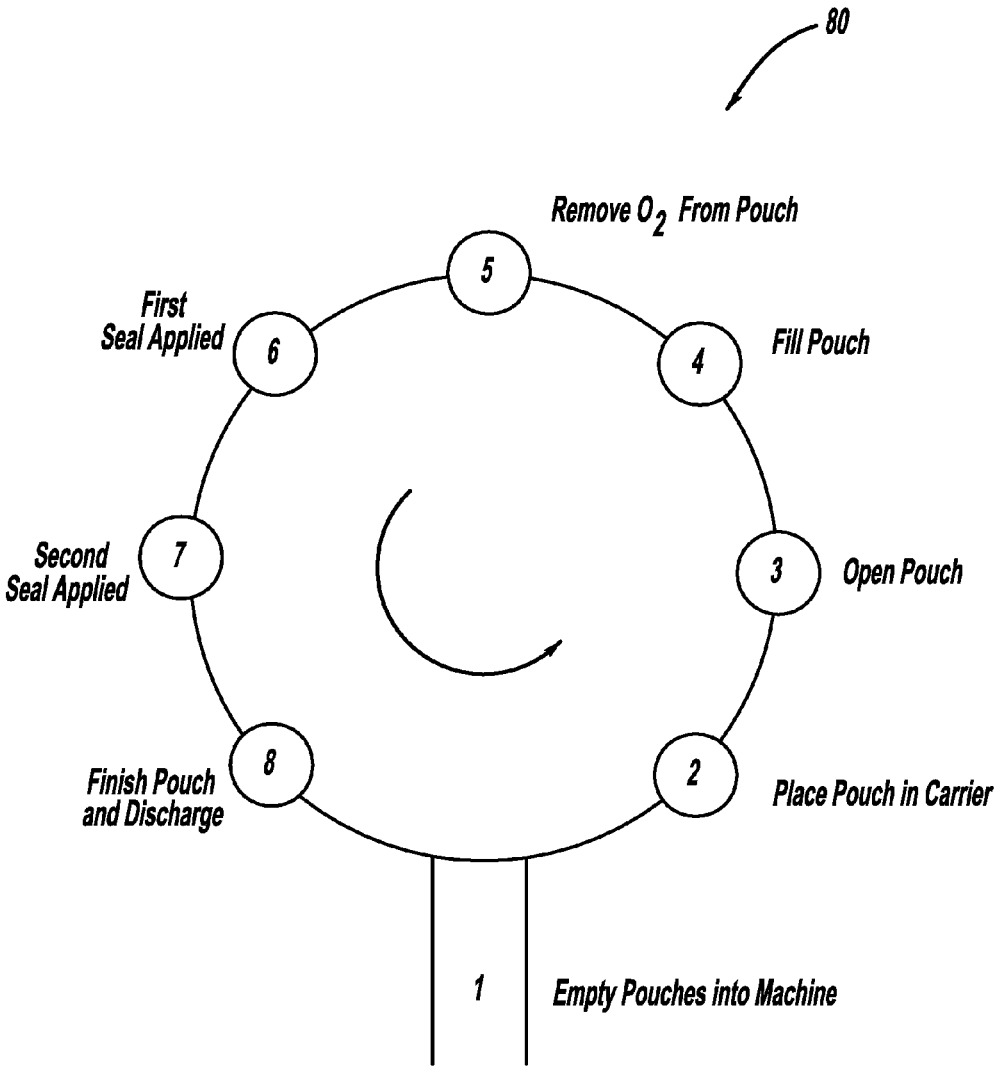
FIG. 10 is a block diagram of a fill-seal machine, according to the present invention.

In block 130, the pouches are loaded onto a fill-seal machine. Advantageously, the fill-seal machine can be integral with the pouch forming machine, or a separate fill-seal machine. It is contemplated that the pouches 10 may be temporarily stored in a magazine between the forming and filling operations. This increases the flexibility of the pouch and may result in a manufacturing cost savings. The fill-seal machine can have stations arranged in a linear manner, or rotary configuration, as shown in FIG. 10.

In block 135, the pre-made pouch 10 is then unloaded from the magazine and loaded into a carrier or holder. It should be appreciated that the pouches are unloaded and uniformly aligned. An example of a holder is a cup-shaped member, as disclosed in commonly assigned U.S. patent application Ser. No. 10/336,601, which is incorporated herein by reference.

Alternatively, the pouch 10 may be held with grippers. The methodology advances to block 140.

In block 140, the pouch 10 is opened in an opening operation. Various techniques are conventionally known in the art for opening the pouch 10.

Various techniques are conventionally known in the art for opening the pouch 10, and may depend on the filling technique. For example, the guide pocket 56 formed by the crease in the front panel 12 and back panel 14 facilitates opening of the pouch. A nozzle (not shown) may be mechanically lowered into the guide pocket 56 to direct a stream of compressed gas into the guide pocket 56, to force the walls of the pouch 10 away from each other. An example of a gas is carbon dioxide or nitrogen. The blowing station may include a manifold, with a hood extending over the top of the edges of the pouch as known in the art. The manifold has rows of apertures (not shown) formed above the upper edges 16 of the panels 12, 14 of the pouch 10. The hood is placed over the pouch 10 to assist in maintaining the air pressure in the pouch 10. The supply of pressurized gas is directed through the aperture to form a plurality of jets of pressurized gas or air. The jets are directed downwardly at the diamond-shaped openings formed at the upper edges 16 to assist in overcoming the surface tension of the panels 12, 14 and assist in separation of the panels 12, 14. A diving rod (not shown) may then be used to make sure the pouch 10 is fully opened.

Figure 9A:
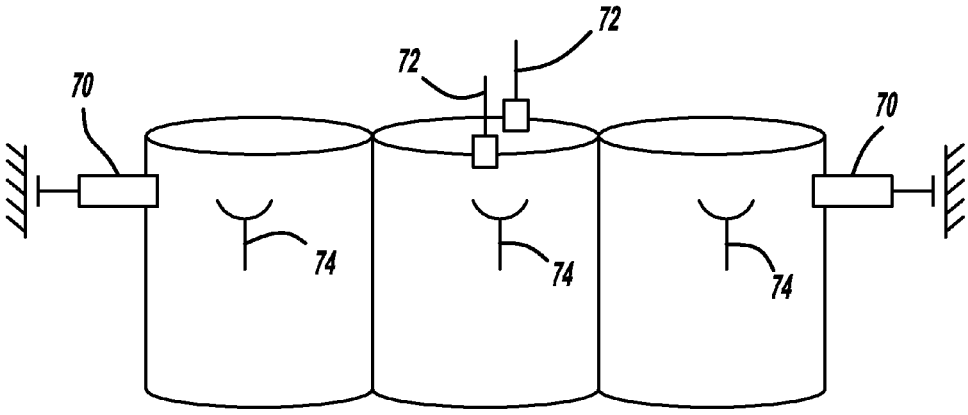
FIGS. 9*a*-9*c* are elevational views of a method of simultaneously opening each pouch compartment.
Figure 9B:
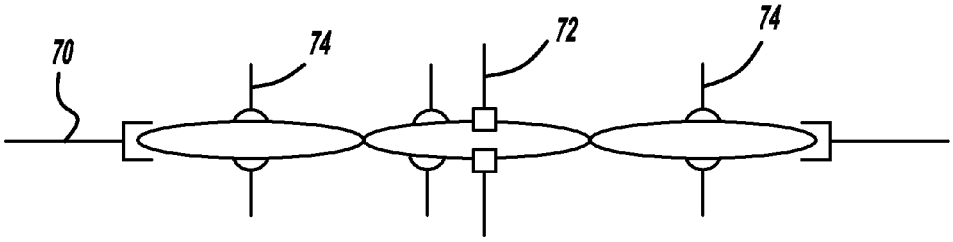
Figure 9C:
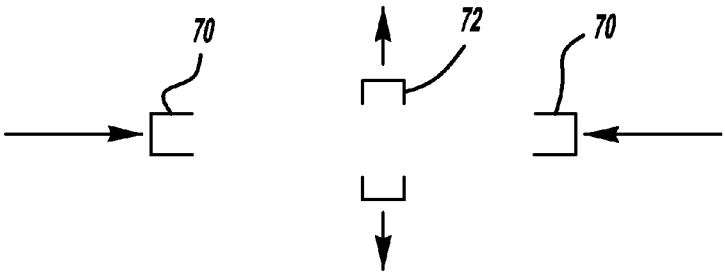

For example, as shown in FIGS. 9*a*-9*c*, for a three-compartment pouch, each compartment of the pouch is opened simultaneously using grippers arranged in a predetermined manner. A first pair of grippers 70 is positioned along each side edge of the pouch. A second pair of grippers 72 is positioned near the upper edge of the front panel and rear panel for the middle compartment. In addition, a third pair of grippers 74 is positioned near the upper edge of the front panel and rear panel for each compartment. The third pair of grippers 74 is of the suction vacuum type. To open the pouch, the side grippers 70 move inwardly towards each other while the grippers 72, 74 adjacent each panel move in an outwardly direction, as shown in FIGS. 9*b* and 9*c*. In this manner, each compartment of the pouch is simultaneously opened.

In addition, a nozzle (not shown) may be mechanically lowered into each guide pocket 56 to direct a stream of compressed gas into the guide pocket 56, to force the walls of the pouch 10 away from each other. An example of a gas is carbon dioxide or nitrogen. The blowing station may include a manifold, with a hood extending over the top of (not shown) the upper edges of the pouch 10, as is known in the art. The manifold has rows of apertures (not shown) formed above the upper edges of the pouch. The hood is placed over the pouch 10 to assist in maintaining the air pressure in the pouch 10. The supply of pressurized gas is directed through the aperture to form a plurality of jets of pressurized gas or air. The jets are directed downwardly at the diamond-shaped openings formed at the upper edges to assist in overcoming the surface tension of the pouch and assist in separation of the walls of each compartment. A diving rod (not shown) may then be used to make sure the pouch 10 is fully opened. It should be appreciated that for a multi-compartment pouch, each compartment may be opened simultaneously using a plurality of gas streams and diving rods. The methodology advances to block 145.

In block 145, at least one compartment of the pouch 10 is filled with the product in a filling operation. For example, a fill tube is lowered into the compartment and the product is dispensed into the open compartment. The fill tube may be lowered into the opened compartment, or through the opening means, such as the spout. The product is preferably dispensed at a predetermined temperature, depending on the type of product. In the case of distinct products, it may be necessary to move the pouches to another fill station to complete the filling of the other compartments. For example, the first and second compartments are filled at a first station with the first two products, and the third compartment containing the third product is filled at another filling station.

If the product is naturally carbonated, such as beer or soda or the like, the pouch may be filled while immersed in a nitrogen bath. If the product is not naturally carbonated, it is immersed in a carbon bath to introduce carbon dioxide into the product, such as carbonator or the like. For example, carbon dioxide is introduced into water or juice to provide a carbonated beverage. The product may contain a mixture of up to two volumes of carbon dioxide. It should be appreciated that the carbon dioxide masks any undesirable taste from the ketones released during the sealing process. The carbon dioxide also increases the pressure within the product so that the walls of the pouch are rigid after the top is sealed. The product may be filled at a temperature ranging from 29° F. to ambient temperature.

The pouches 10 may be moved to a station where any oxygen in the pouch residing above the product is removed, if necessary. For example, the carbon dioxide in the product is released and rises to the top of the pouch and into the nitrogen bath. The presence of carbon dioxide and nitrogen in a product, such as water, prohibits the growth of bacteria and the formation of mold, as well as enhancing the flavor and aroma of the product. This can be done by providing a hood or diving nozzle where oxygen is either evacuated or replaced with carbon dioxide or nitrogen into the pouch to displace the oxygen. A diving nozzle is used to inject the gas.

For example, if the product is naturally carbonated, such as beer or soda or the like, the pouch is preferably filled while immersed in a nitrogen atmosphere. If the product is not naturally carbonated and carbonation is desirably, it may be immersed in a carbonator to introduce carbon dioxide into the product. For example, carbon dioxide is introduced into water or juice to provide a carbonated beverage. The product may contain a mixture of up to four volumes of carbon dioxide. It should be appreciated that the carbon dioxide masks any undesirable taste from the ketones released during the sealing process. The carbon dioxide also increases the pressure within the product so that the walls of the pouch are rigid after the top is sealed. The product is preferably filled at a temperature ranging from 29° F. to ambient temperature. The methodology advances to block 150.

In block 150, the pouch is sealed. If the pouch is filled through open edges, such as the upper edge, the upper edge 16 of the pouch is closed by applying a closing seal, as previously described. The closing seal may be an ultrasonic seal or an ultra pulse seal or a heat weld or the like. In another example the closing seal is an insulating seal, as previously described, used to form an insulated compartment. In this example, a first insulating seal 50 has a predetermined shape and a second insulating seal 50*b* is spaced a predetermined distance from the first.

It should be appreciated that the steps of filling and sealing may be repeated for each compartment of a multi-compartment pouch, if necessary. That is, one compartment is filled and sealed, and then the adjacent compartment is filled and sealed.

If the compartment holds a carbonated beverage, the pouch may be sealed as described in commonly owned PCT Patent Application No. PCT/US03/034396, which is incorporated herein by reference. A second cosmetic seal may be applied over the first seal for a carbonated product. The second seal may be a heat weld. Some of the product may be trapped between the first and second seals. This is advantageous since there is no gas in the head space, i.e. the region between the product and the heat seal, and less pouch material is required.

In block 155, the filled pouch 10 is finished in a finishing operation. For example, the edges of the pouch may be trimmed to achieve a predetermined pouch shape. In addition, the filled pouch may be cooled at a cooling station using a conventionally known cooling technique. The methodology advances to block 160.

In block 160, the filled pouch 10 is discharged from the machine. For example, the pouches are moved to a discharge station where the receptacles are moved from the arm of the turret outwardly onto a conveyor. The receptacles are then moved by the conveyor under robotic arms having grippers, which are then lowered to grab the pouch 10 and lift the pouch 10 from the receptacles. The receptacles are then moved by the conveyor through a rinsing station and returned to the other side of the turret for use. The pouches 10 are placed by the grippers into cartons. At this point, the filled pouch is available for distribution.

It should be appreciated that the methodology may include other steps, such as an upstream oxygen purging station, a downstream oxygen purging station, or pasteurization or the like. For example, the filled pouch may be pasteurized in an integral retort chamber (not shown) that heats and then cools the pouch. The pouch may be tested, such as burst testing or the like prior to packaging for shipping. These additional processing steps may take place at a station on the form/fill/seal apparatus, or on another apparatus.

It is also contemplated that the order of implementing the steps may vary to facilitate the manufacturing process. In addition, a manufacturing station may perform one or a plurality of operations, to enhance the efficiency of the methodology and apparatus.

Referring to FIG. 10, a fill-seal machine for filling the pouch is illustrated. Various machine configurations are contemplated for filling the pouch 10, such as a turret-type machine, or a continuous motion cup receptacle machine, or an intermittent machine. The fill machine illustrated is by way of example, and other configurations may be utilized. It should be appreciated that a particular manufacturing station may perform one or more operations. It should also be appreciated that the order of operations may vary. The fill-seal machine 80 may be configured as a flat bed, a conveyor, a rotary turret or the like. An example of a flat bed form machine is manufactured by Nishibe, such as the model number SBM500, SMB600 or SMB700. It should be appreciated that the fill-seal machine may be integral with the form machine, or a separate machine.

In operation, the carrier with the pouch 10 is loaded onto the machine 80 as shown at station 1. The pouches 10 are removed from the receptacle and placed in a holder as shown at station 2, such as by using a gripper.

The pouch 10 is transported along the conveyor belt to operation station 3, and the pouch 10 is opened in an opening operation. Various techniques are conventionally known in the art for further opening the pouch 10. The pouch compartments may be opened using the opening grippers as previously described. The guide pocket formed by the crease in the front panel and back panel facilitates opening the upper edges of the pouch, as previously described. The lever arms assist in maintaining the pouch in an open position.

The fully opened pouch 10 is transferred to a filling station as indicated at station 4, and the pouch is filled with the product. For example, a nozzle dispenses a predetermined amount of product into the opened pouch. The product may be dispensed into the opened edges of the pouch or through a fitment. In this example, the fill nozzle is lowered into the opened pouch, and the product is dispensed into the open pouch. Depending on the number of compartments and type of products, there may be more than one filling station.

If the product is naturally carbonated, such as beer or soda or the like, the pouch is preferably filled while immersed in a nitrogen atmosphere. If the product is not naturally carbonated, it is immersed in a carbonator to introduce carbon dioxide into the product. For example, carbon dioxide is introduced into cold water or juice to provide a carbonated beverage. The product may contain a mixture of up to four volumes of carbon dioxide. It should be appreciated that the carbon dioxide masks any undesirable taste from ketones and other solvents released during the sealing process. The carbon dioxide also increases the pressure within the product so that the walls of the pouch 10 are rigid after the top is sealed. The product is preferably filled at a temperature ranging from 29° F. to ambient temperature. The carbonation is advantageous as a microbiocide which can enhance the flavor or prevent mold or contamination.

The pouch 10 is transferred to station 5 for removing any oxygen from the pouch. The pouch is then transferred to a sealing station and the open edges of the pouch are sealed using a closing seal, as indicated at station 6. For example, at the sealing station 6, the lifting surface ends, causing the lever arms to return to their original position, and the pouch to close. It should be noted that the filled pouch might return to a partially closed position due to the product contained therein. The closing seal may be a thermal seal. For example, a heat-sealing member extends therethrough the slots in the sides of the cup, to seal the upper edge of pouch.

Another example of a closing seal for a carbonated product utilizes an ultrasonic sealing process. A first closing seal is applied, and the first closing seal is an ultrasonic seal that includes sound waves and is formed using a horn and anvil. The sealing process for a carbonated product may produce a small amount of foam on the top of the product, which forces excess oxygen upwardly. The first seal is formed across the foam at the top of the liquid to ensure that no oxygen remains in the product compartment of the pouch. A second closing seal may be applied at a second sealing station 7. The second closing seal may be applied using a heat seal means to form a second heat seal over the first seal. It should be appreciated that the second seal is spaced slightly outboard the first seal by a predetermined distance. The second heat-sealing station 7 is conventional and utilizes heat or a combination of heat and pressure to form the seal. The second seal may also be a cosmetic seal or another type of seal, such as ultrasonic, ultra pulse or the like. The first and second seals are applied for a carbonated product as disclosed in commonly assigned Patent Application No. PCT/US03/34396, which is incorporated herein by reference.

The closing seal may form an insulated handle by forming a first seal having a predetermined shape, and a second seal having a predetermined shape spaced apart from the first seal. The shape of the seal may cause the pressure of contained gas within the sealed compartment to increase.

The pouch is transferred to a finishing station 8 for finishing and removal from the filling machine. For example, the pasteurized pouch 10 may be cooled. A tear notch may be formed in the pocket portion of the pouch to facilitate opening the pouch to access the product in the pouch. In another finishing operation, the edges of the pouch are trimmed to achieve a desired shape. The finished pouches may be discharged into a package. For example, transfer grippers may be utilized to place the pouch in a box for shipment.

If desired, the pouch may be transferred to a pasteurization station. Pasteurization enhances the shelf life of the product. The pouch is inserted into an enclosed retort chamber. Air is extracted from the chamber, such as using a vacuum source. The product inside the pouch is pasteurized. For example, a combination of steam and water is used to heat the pouch to a predetermined temperature for a predetermined period of time to pasteurize the product contained within the pouch. The package is then cooled. In this example, recirculated water surrounds the pouch to cool the pouch. In certain instances, it may be desirable to apply steam to sterilize the pouch 10 and to wet the inner surface of the walls to facilitate handling.

The present invention has been described in an illustrative manner. It is to be understood that the terminology which has been used is intended to be in the nature of words of description rather than of limitation.

Many modifications and variations of the present invention are possible in light of the above teachings. Therefore, the present invention may be practiced other than as specifically described.

The invention claimed is:

1. A multi-compartment flexible pouch with an insulated compartment, comprising:

a body of the pouch formed from a panel of material, wherein the pouch body includes at least one compartment for a product;

an opening means for accessing the product disposed in the pouch body; and a first insulating compartment defined by a first seal spaced apart from a second seal, the first seal defining an upper edge of the pouch, the first seal extending along an axis, the second seal having an outer edge exposed within the first insulating compartment seal and spaced apart from the first seal, the outer edge following an undulating pattern so as to define a scalloped shaped seal, wherein the first insulating compartment is dimensioned to be gripped by a user, and wherein the first insulating compartment is filled with gas to a predetermined pressure, the gas filled first insulating compartment reducing the temperature of the surface of the first insulating compartment relative to the temperature of the surface of the product compartment when the pouch is heated, facilitating the grip of a heated pouch by the first insulating compartment.

2. The multi-compartment flexible pouch as set forth in claim 1 wherein the pressurized gas is air.

3. The multi-compartment flexible pouch as set forth in claim 1 wherein the pressure within the first insulating compartment is greater than the pressure within the product compartment at an ambient temperature.

* * * * *